US007540316B2

(12) United States Patent
Collette et al.

(10) Patent No.: US 7,540,316 B2
(45) **Date of Patent: *Jun. 2, 2009**

(54) METHOD FOR INDUCTIVE HEATING AND AGITATION OF A MATERIAL IN A CHANNEL

(75) Inventors: Wayne N. Collette, Merrimack, NH (US); Kyle B. Clark, Underhill, VT (US); Valery Kagan, Colchester, VT (US); Stefan von Buren, Colchester, VT (US)

(73) Assignee: iTherm Technologies, L.P., Merrimack, NH (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/505,022

(22) Filed: Aug. 16, 2006

(65) Prior Publication Data

US 2008/0041551 A1 Feb. 21, 2008

(51) Int. Cl.
*B22D 17/10* (2006.01)
*B22D 27/02* (2006.01)

(52) U.S. Cl. ..... 164/113; 164/312; 164/493; 164/900; 219/644

(58) Field of Classification Search ..... 164/113, 164/312–318, 900, 493, 498, 250.1, 513; 219/643–644

See application file for complete search history.

(56) References Cited

U.S. PATENT DOCUMENTS

| | | | | |
|---|---|---|---|---|
| 1,852,215 | A | 4/1932 | Northrup | |
| 2,829,227 | A | 4/1958 | Antonis | |
| 2,875,311 | A | 2/1959 | Harkenrider | |
| 2,947,045 | A * | 8/1960 | Goldhamer | 164/303 |
| 3,376,403 | A | 4/1968 | Mircea | |
| 3,536,983 | A | 10/1970 | Kennedy | |
| 3,620,294 | A | 11/1971 | Hetzel et al. | |
| 4,704,509 | A | 11/1987 | Hilmersson et al. | |
| 5,012,487 | A | 4/1991 | Simcock | |
| 5,101,086 | A | 3/1992 | Dion | |
| 5,385,200 | A | 1/1995 | Yuki et al. | |

(Continued)

FOREIGN PATENT DOCUMENTS

DE 965761 C 6/1957

(Continued)

OTHER PUBLICATIONS

International Search Report and Written Opinion mailed Dec. 20, 2007 in a related application Serial No. PCT/US2007/018125 (U.S. Appl. No. 11/505,059).

(Continued)

*Primary Examiner*—Kuang Lin
(74) *Attorney, Agent, or Firm*—Rissman Hendricks & Oliverio LLP

(57) ABSTRACT

Method for inductive heating of a material located in a channel, the material having a melting range between a solidus temperature and a liquidus temperature. The method includes providing an internal inductive heating assembly in the material in the channel, and supplying a signal to the assembly to generate a magnetic flux in at least one of the assembly and material. The magnetic flux generates inductive heating of the assembly and/or the material and a physical agitation which lowers the solidus temperature of the material to a reduced solidus temperature.

23 Claims, 4 Drawing Sheets

U.S. PATENT DOCUMENTS

| | | | | |
|---|---|---|---|---|
| 5,713,069 | A | 1/1998 | Kato | |
| 5,902,509 | A | 5/1999 | Bruckner et al. | |
| 6,084,225 | A | 7/2000 | Schmitt | |
| 6,460,596 | B1 * | 10/2002 | Yamaguchi et al. | 164/72 |
| 6,546,039 | B2 | 4/2003 | Fishman | |
| 6,798,822 | B2 | 9/2004 | Fishman et al. | |
| 6,892,970 | B2 | 5/2005 | Nussio | |
| 7,034,263 | B2 | 4/2006 | Kagan | |
| 7,034,264 | B2 | 4/2006 | Kagan | |
| 7,049,562 | B2 | 5/2006 | Tanino et al. | |
| RE39,291 | E | 9/2006 | Kestle et al. | |
| 7,140,873 | B1 | 11/2006 | House | |
| 2002/0189781 | A1 | 12/2002 | Shibata et al. | |
| 2003/0057201 | A1 | 3/2003 | Johnson | |
| 2003/0067376 | A1 | 4/2003 | Maenosoni | |
| 2003/0132224 | A1 | 7/2003 | Spencer | |
| 2004/0028111 | A1 | 2/2004 | Fishman et al. | |
| 2004/0084171 | A1 * | 5/2004 | Akers et al. | 164/113 |
| 2005/0191098 | A1 | 9/2005 | Ueno et al. | |
| 2006/0076338 | A1 | 4/2006 | Kagan | |
| 2006/0093413 | A1 | 5/2006 | Matsumoto | |

FOREIGN PATENT DOCUMENTS

| | | | |
|---|---|---|---|
| DE | 3118030 | A1 | 12/1982 |
| DE | 102005021238 | A1 | 11/2006 |
| EP | 0403138 | A | 12/1990 |
| GB | 508255 | A | 6/1939 |
| JP | 1-170547 | * | 7/1989 |
| JP | 1-313134 | * | 12/1989 |
| JP | 2004 108666 | A | 4/2004 |
| JP | 2005-259558 | A | 9/2005 |

OTHER PUBLICATIONS

International Search Report and Written Opinion mailed Mar. 26, 2008 in a related application Serial No. PCT/US2007/018041 (U.S. Appl. No. 11/505,023).

International Search Report and Written Opinion mailed Apr. 24, 2008 in a related application Serial No. PCT/US2007/018171 (U.S. Appl. No. 11/505,022).

International Search Report and Written Opinion mailed Dec. 28, 2007 in corresponding application Serial No. PCT/US2007/018113.

* cited by examiner

METHOD FOR INDUCTIVE HEATING AND AGITATION OF A MATERIAL IN A CHANNEL

FIELD OF THE INVENTION

This invention relates to a method for inductive heating of a material located in a channel, wherein an internal inductive heating assembly is provided in the material in the channel which produces a magnetic flux generating inductive heating of the assembly and/or material and a physical agitation which lowers a solidus temperature of the material.

BACKGROUND OF THE INVENTION

It is common practice to inductively heat an article (e.g., a solid cylinder or hollow tube) of a magnetizable material, such as steel, by inducing an eddy current in the article. This eddy current is induced by an applied magnetic flux generated by passage of an alternating current through a heater coil wound around the article. The heat inductively generated in the article may then be transmitted to another article, e.g., a metal or polymer material flowing through a bore or channel of an inductively heated steel tube.

Various systems have been proposed which utilize different combinations of materials, structural heating elements, resonant frequencies, etc., for such heating techniques. There is an ongoing need for an apparatus and method for heating a material in a channel which provides one or more of higher power density, tighter temperature control, reduced power consumption, longer operating life, and/or lower manufacturing costs.

SUMMARY OF THE INVENTION

In accordance with one embodiment of the invention, a method is provided for heating a material located in a channel. The material has a melting range between a solidus temperature and a liquidus temperature. The method includes the steps of providing an internal inductive heating assembly in the material in the channel, and supplying a signal to the assembly to generate a magnetic flux in at least one of the assembly and the material. The magnetic flux generates inductive heating of the assembly and/or material and also a physical agitation which lowers the solidus temperature of the material to a reduced solidus temperature.

The agitation may comprise, for example, a vibration in a frequency range of 5 to 500 kilohertz (kHz).

In various embodiments, the material is heated from a nonflowable state to a flowable state. The nonflowable state may be a solid state at or below the reduced solidus temperature and the flowable state a semi-solid state. The semi-solid state may be below the solidus temperature and above the reduced solidus temperature. When the material is in a flowable state the physical agitation of the material (directly or via the sheath) may effectively produce a stirring of the material.

In various embodiments, the supplied signal is adjusted to produce a desired range of temperature cycling of the material, which includes a change of the material into or from a flowable state across the reduced solidus temperature. The change of the material may be between a solid state and a semi-solid state.

In another embodiment, the supplied signal is varied to provide alternate heating and cooling of the material across the reduced solidus temperature.

In one embodiment, the channel is provided in an outer element, and the method includes cooling of the material by thermal conduction of heat from the material to the outer element.

In another embodiment, the internal inductive heating assembly includes an exterior sheath disposed in contact with the material and an interior coil inductively coupled to the sheath. The signal is supplied to the coil to generate the magnetic flux in one or both of the sheath and the material. Both the inductive heating and physical agitation may be generated in the sheath. The physical agitation generated in the sheath may then be transmitted to the material. Alternatively, or in addition, both the inductive heating and physical agitation may be generated in the material.

In various other embodiments, the inductive heating and/or physical agitation are generated in only one, but not both, of the inductive heating assembly and the material.

The material may be a metal alloy. The material may be a metal containing composition, such as a metal/polymer composition, a metal/ceramic composition, and/or a metal matrix composition. The material may be one or more of an eclectically conductive, ferromagnetic, electrically non-conductive, thermally insulating and thermally conductive material.

The signal supplied to the coil may comprise current pulses providing high frequency harmonics in the coil. This signal is particularly useful in systems having a high damping coefficient which are difficult to drive (inductively) with sustained resonance.

These and other features and/or advantages of several embodiments of the invention may be better understood by referring to the following detailed description in conjunction with the accompanying drawings.

DETAILED DESCRIPTION

In accordance with various embodiments of the invention, an inductive heating apparatus generates a physical agitation of a material being heated. This heating by agitation lowers the solidus temperature and thus extends the temperature range in which the material exists in a flowable or semi-solid state.

Figure 4:
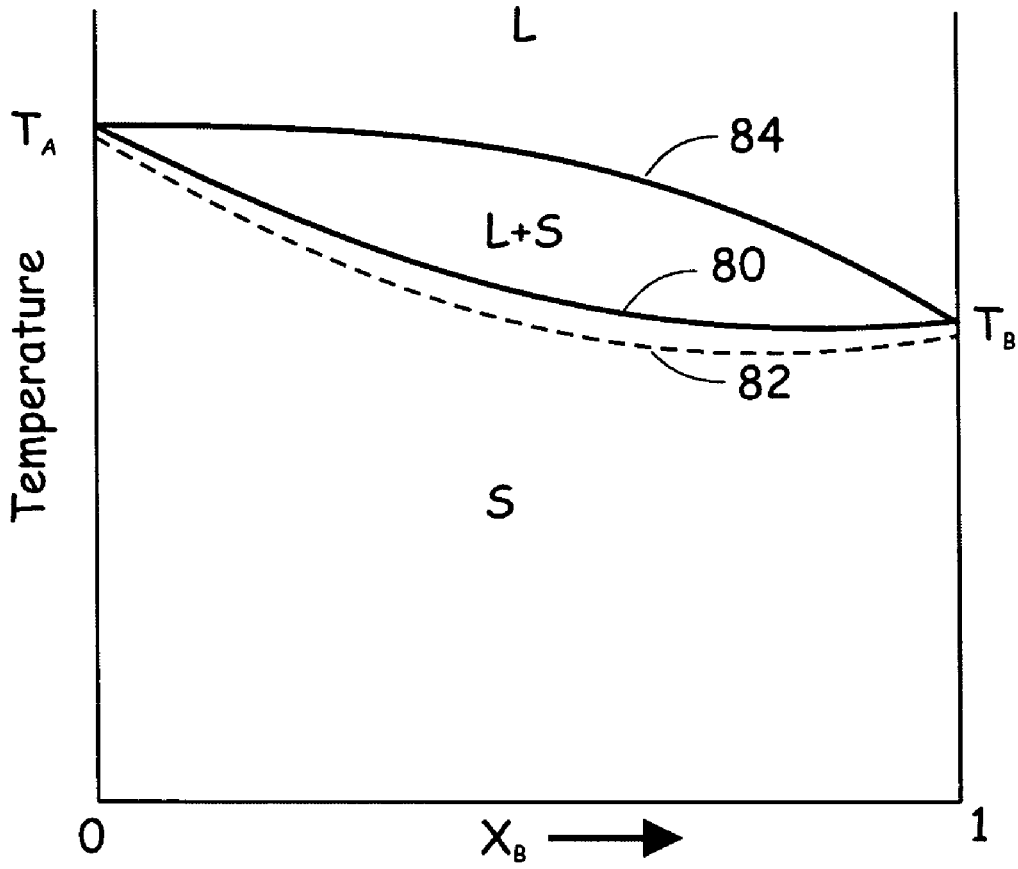
FIG. 4 is an example of a two component temperature-composition diagram at constant pressure illustrating an extension of the melting range, by lowering of the solidus temperature, due to physical agitation of the material in accordance with one embodiment of the invention.

FIG. 4 illustrates this effect of physical agitation, where an extended liquid-solid temperature range is provided by a lowering of the normal solidus temperature curve 80 to a reduced solidus temperature curve 82. More specifically, FIG. 4 (apart from showing the reduced solidus temperature curve caused by agitation) is a typical two-component (A and B) binary phase diagram indicating those phases present in equilibrium at any particular temperature and composition at a constant pressure. Temperature is plotted as the ordinate and composition as the abscissa. In the system AB, the composition is usually expressed in terms of mole fraction or weight percentage of B. At low temperatures, the only phase present is the solid designated by S in the phase diagram. Pure A melts at the temperature $T_A$ and pure B melts at the temperature $T_B$. Compositions between pure A (mole fraction of B=0) and pure B (mole fraction of B=1) exist only in the solid state of aggregation until the temperature of the solidus line is reached. The solidus is represented in the phase diagram by the lower curve extending from $T_A$ to $T_B$. Below the solidus temperature only solid exists. However, above the solidus, there is two-phase region (L+S) in which both liquid and solid phases are in equilibrium. The L+S region extends from the solidus temperature over a finite temperature interval for all alloys of the system AB.

The upper boundary of the liquid-plus-solid region is a liquidus temperature curve 84. Above this temperature, any alloy of the system exists as a liquid phase (until the temperature increases to a level at which vaporization begins).

In accordance with the invention, the lower solidus temperature 80 has been reduced to a reduced solidus temperature 82, due to physical agitation of the material in a channel, as described further below.

Figure 3:
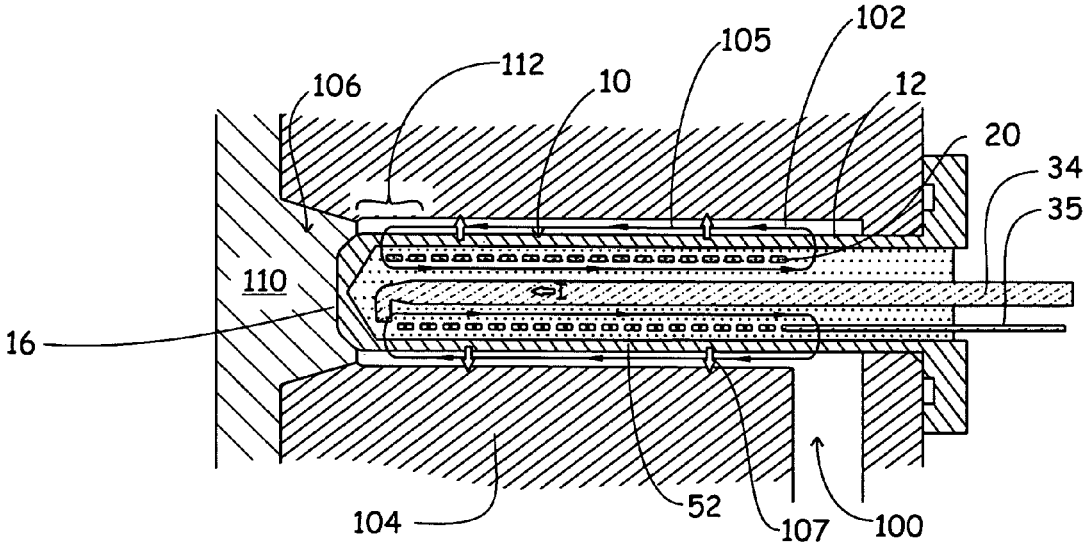
FIG. 3 is a schematic cross-sectional view of a probe heater similar to that shown in FIG. 1, disposed at the gate end of an injection molding system, illustrating use of a probe heater to melt a plug formed adjacent the gate area and showing the electromagnetic force vectors applying physical agitation to the material in accordance with one embodiment of the invention.

A particular application of the method of the invention is illustrated in FIG. 3, which shows generally the inductive heating of a material in a channel by an internal inductive heating assembly located in the material in the channel, wherein providing agitation of the material in the channel (see arrows 107), in addition to inductive heating, lowers the solidus temperature. By thus lowering the solidus temperature, a heating and/or cooling process of the material in the channel can be conducted at a lower temperature and/or provide a savings in one or more of time, cost of materials, power consumption, and operating life, as well as expanding the useful applications of the heating and/or cooling process to different materials.

Figure 1:
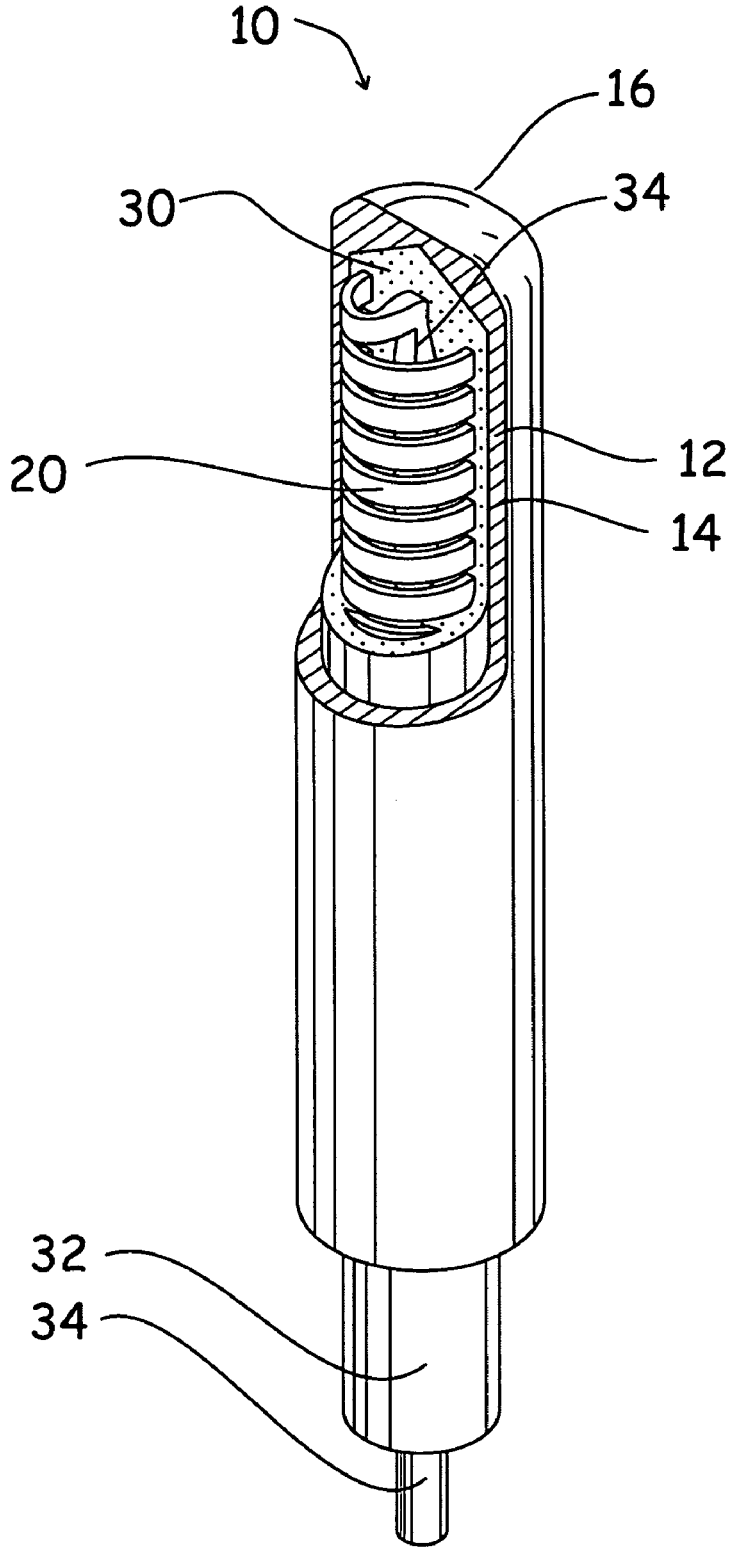
FIG. 1 is a schematic view of a probe heater useful in one embodiment of the invention, including a partial cut-away view showing the interior inductive coil and dielectric insulation inside the outer ferromagnetic sheath.
Figure 2:
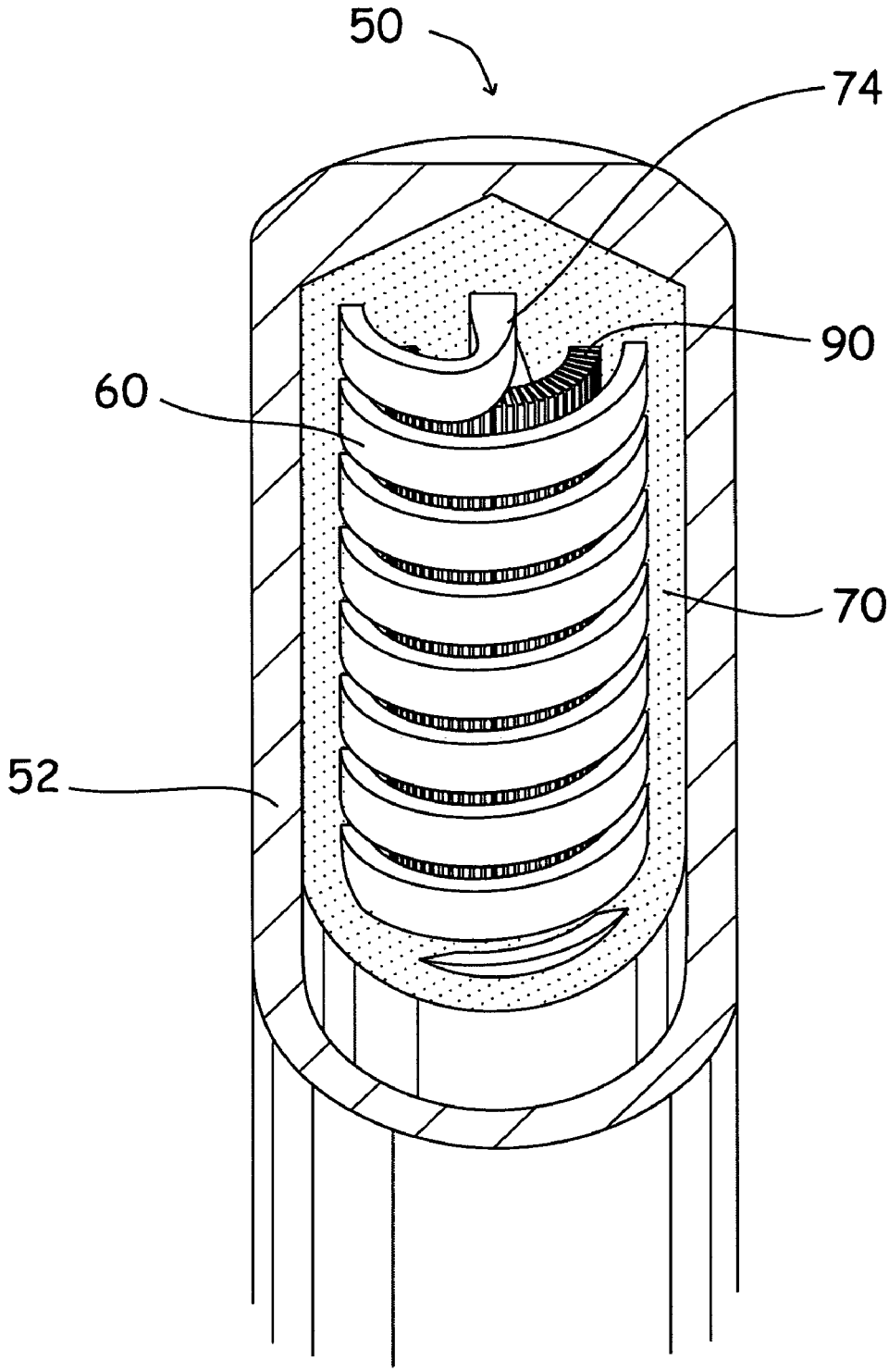
FIG. 2 is an expanded, partial cut-away view of another probe heater, similar to that of FIG. 1 but further including a flux concentrator disposed radially interior to the inductor coil.

Before returning to FIG. 3, a general description of a suitable inductive heating assembly is provided with reference to FIGS. 1-2.

A first embodiment of an inductive heating assembly is illustrated in FIG. 1, herein referred to as a probe heater 10. The heater 10 has a generally elongated profile and is adapted to be disposed in a channel (see FIG. 3) for heating of a material in the channel. The heating assembly includes a generally cylindrical exterior ferromagnetic sheath 12 having a hollow interior 14 and being closed at one end 16. Within the hollow interior of the sheath is a heating element or inductor coil 20, here provided as a substantially helical coil extending along an axial length of the sheath. Dielectric insulation 30 is provided in and around the coil, including between the individual turns of the coil, for electrically isolating the coil 20 from the sheath 12. The coil has coaxial power leads, including an outer cylindrical lead 32 connecting to one end of the coil, and a central axial lead 34 connecting to the other end of the coil and extending along the cylindrical axis of the coil/assembly.

FIG. 2 illustrates a second embodiment of a heater probe 50 which is similar to the first embodiment but further includes a ferromagnetic flux concentrator for closing the magnetic loop with the outer sheath. Similar to FIG. 1, the heating assembly of FIG. 2 includes an outer ferromagnetic sheath 52, a coiled heating element 60, dielectric insulation 70, and concentric power leads (return lead 74 is shown). The assembly further includes a substantially cylindrical flux concentrator 90 concentrically disposed within the coil 60 and extending axially along a length of the heating assembly. This high permeability flux concentrator enhances the magnetic field by forming a closed magnetic loop with the exterior sheath 52, thus increasing the magnetic coupling between the coil 60 and sheath 52. The flux concentrator preferably has an open current loop (e.g., slotted as shown) to reduce the eddy currents (and thus heat) generated in the flux concentrator.

FIG. 3 illustrates one application of the heating assembly of FIG. 1 disposed in a channel 102 (a tubular passage or conduit for a flowable material), the channel being located in an outer element 104. The outer element 104 may be, for example, a mold insert, a hotrunner manifold or a nozzle, having a melt channel 102 through which a flowable material 100, such as a conductive liquid metal, is adapted to flow. The channel at one end of the outer element has a tapered region or gate area 106, also referred to as a separation area, enabling a molded part 110, formed in the gate area 106 and in an adjacent mold cavity, to be separated from the material remaining in the melt channel 102. The flowable material travels through the channel toward the gate 106 and into the mold cavity, where it is cooled to a nonflowable solid state and forms a molded part 110. In order to provide a clean break at the gate (preferably no drool from the gate), the material in the channel area 112 adjacent to the gate area 106 must be cooled from a flowable (e.g., liquid or semi-solid state) to a nonflowable (e.g., physically rigid or semi-rigid (deformable) state). The nonflowable material which forms and remains in the channel area 112 adjacent to gate 106, is typically referred to as a plug. Formation of a plug thus enables the clean separation of the solidified material in the gate area 106 (the molded part) when the mold is opened (e.g., a mold core is moved away from the opposite side of the mold). Cooling of the material in channel area 112 adjacent the gate region can be accomplished by thermal conduction, e.g. by conduction of heat toward the molded part 110 (which is in contact with the cooler mold core and cavity walls); by providing an additional cooling medium at or near the gate area 106 to draw heat away from the material in channel area 112; and/or by any other process parameter(s) which reduce the temperature of the material in channel area 112.

During a next molding cycle, the nonflowable plug must again be heated to a fluid (flowable) state. For this purpose, an inductive heating assembly (probe heater 10) is positioned in the material in the channel 102, with the closed end 16 of the outer sheath disposed at or near the separation area 106. The probe heater 10 is centrally disposed in the channel 102 and is surrounded by a relatively narrow annular width of open channel area. A plug of material will be formed around the sheath in the area 112 at the gate end of the channel. In order to melt the plug (reduce its viscosity) so that material can again be injected through the gate, a magnetic field (see lines 105) is generated by the interior coil 20 of the probe which is transmitted to one or more of the exterior sheath 52 and the material 100 in the channel for inductive heating of the sheath and/or material respectively. In addition to inductive heating, the plug material is also heated by agitation (see arrows 107) of the plug material. The plug is thus heated and converts back to a fluid state, allowing the material to flow around the exterior sheath and exit through the gate 106.

The probe heater according to the present invention is not limited to specific materials, shapes or configurations of the components thereof. A particular application or environment will determine which materials, shapes and configurations are suitable.

For example, the inductor coil may be one or more of nickel, silver, copper and nickel/copper alloys. A nickel (or high percentage nickel alloy) coil is suitable for higher temperature applications (e.g., 500 to 1,000° C.). A copper (or high percentage copper alloy) coil may be sufficient for lower temperature applications (e.g., <500° C.). The coil may be stainless steel or Inconel (a nickel alloy). In the various embodiments described herein, the water cooling of the coil is not required nor desirable.

The power leads supplying the inductor coil may comprise an outer cylindrical supply lead and an inner return lead concentric with the outer cylindrical supply lead. The leads may be copper, nickel, Litz wire or other suitable materials.

The dielectric insulation between the inductor coil and outer ferromagnetic sheath may be a ceramic such as one or more of magnesium oxide, alumina, and mica. The dielectric may be provided as a powder, sheet or a cast body surrounding the coil.

The coil may be cast on a ceramic dielectric core, and a powdered ceramic provided as a dielectric layer between the coil and sheath.

The coil may be cast in a dielectric ceramic body and the assembly then inserted into the sheath.

The sheath may be made from a ferromagnetic metal, such as a series 400 stainless steel or a tool steel.

The flux concentrator may be provided as a tubular element disposed between the coil and the return lead. The flux concentrator may be a solid, laminated and/or slotted element. For low temperature applications, it may be made of a non-electrically conductive ferromagnetic material, such as ferrite. For higher temperature applications it may comprise a soft magnetic alloy (e.g., cobalt).

The coil geometry may take any of various configurations, such as serpentine or helical. The coil cross-section may be flat, round, rectangular or half round. As used herein, coil is not limited to a particular geometry or configuration; a helical wound coil of flat cross section as shown is only one example.

As used herein, heating includes adjusting, controlling and/or maintaining the temperature of a material in a channel.

In a more specific embodiment, given by way of example only and not meant to be limiting, the probe heater may be disposed in a melt channel for heating magnesium. The heater may comprise a tool steel outer sheath, a nickel coil, an alumina dielectric, and a cobalt flux concentrator. The nickel coil, steel sheath and cobalt flux concentrator can all withstand the relatively high melt temperature of magnesium. The nickel coil will generally be operating above its Curie Temperature (in order to be above the melt temperature of the magnesium); this will reduce the "skin-effect" resistive heating of the coil (and thus reduce over-heating/burnout of the coil). The steel sheath will generally operate below its Curie Temperature so as to be ferromagnetic (inductively heated), and will transfer heat by conduction to raise the temperature of the magnesium in which it is disposed (during heat-up and/or transient operation). The sheath may be above its Curie Temperature once the magnesium is melted, e.g., while the magnesium is held in the melt state (e.g., steady state operation or temperature control). The coil will be cooled by conductive transmission to the sheath. Preferably the Curie Temperature of the flux concentrator is higher than that of the sheath, in order to maintain the permeability of the flux concentrator, close the magnetic loop, and enhance the inductive heating of the sheath.

Again, the specific materials, sizes, shapes and configurations of the various components will be selected depending upon the particular material to be heated, the cycle time, and other process parameters.

In various applications of the described inductive heating method and apparatus, it may generally be desirable that the various components have the following properties:

the coil is electrically conductive, can withstand a designated operating temperature, and is paramagnetic at the operating temperature;

the sheath is ferromagnetic at the desired operating temperature, is thermally conductive, is electrically conductive, and has a relatively uninterrupted path for the eddy current to flow;

the dielectric material is electrically insulative, thermally conductive, and substantially completely paramagnetic;

the flux concentrator does not exceed its Curie point during operation, has a high permeability, can withstand high operating temperatures, and has an interrupted (restricted) circumferential path for the eddy current to flow;

the material is in good thermal contact with the sheath.

In applications where there is direct coupling of the magnetic field to the material, the desired parameters of the sheath are also desired parameters of the material.

The material in the channel to be heated will also effect the parameters of the assembly components, the applied signal and the heating rates. In various embodiments, the material may include one or more of a metal and a polymer, e.g., a pure metal, a metal alloy, a metal/polymer mixture, etc. In other embodiments the assembly/process may be useful in food processing applications, e.g., where grains and/or animal feed are extruded and cooled.

In various applications, it may be desirable to supply a signal to the coil comprising current pulses having a desired amount of pulse energy in high frequency harmonics for inductive heating of the sheath, as described in Kagan U.S. Pat. Nos. 7,034,263 and 7,034,264, and in Kagan U.S. Patent Application Publication No. 2006/0076338 A1, published Apr. 13, 2006 (U.S. Ser. No. 11/264,780, entitled Method and Apparatus for Providing Harmonic Inductive Power). The current pulses are generally characterized as discrete narrow width pulses, separated by relatively long delays, wherein the pulses contain one or more steeply varying portions (large first derivatives) which provide harmonics of a fundamental (or root) frequency of the current in the coil. Preferably, each pulse comprises as least one steeply varying portion for delivering at least 50% of the pulse energy in the load circuit in high frequency harmonics. For example, the at least one steeply varying portion may have a maximum rate of change of at least five times greater than the maximum rate of change of a sinusoidal signal of the same fundamental frequency and RMS current amplitude. More preferably, each current pulse contains at least two complete oscillation cycles before damping to a level below 10% of an amplitude of a maximum peak in the current pulse. A power supply control apparatus is described in the referenced patents/application which includes a switching device that controls a charging circuit to deliver current pulses in the load circuit so that at least 50% (and more preferably at least 90%) of the energy stored in the charging circuit is delivered to the load circuit. Such current pulses can be used to enhance the rate, intensity and/or power of inductive heating delivered by a heating element and/or enhance the lifetime or reduce the cost in complexity of an inductive heating system. They are particularly useful in driving a relatively highly damped load, e.g., having a damping ratio in the range of 0.01 to 0.2, and more specifically in the range of 0.05 to 0.1, where the damping ratio, denoted by the Greek letter zeta, can be determined by measuring the amplitude of two consecutive current peaks $\alpha_1$, $\alpha_2$ in the following equation:

$$\zeta = \frac{-\ln\left(\frac{a_2}{a_1}\right)}{2\pi}$$

This damping ratio, which alternatively can be determined by measuring the amplitudes of two consecutive voltage peaks, can be used to select a desired current signal function for a particular load. The subject matter of the referenced Kagan patents/application are hereby incorporated by reference in their entirety.

These and other modifications will be readily apparent to the skilled person as included within the scope of the following claims.

The invention claimed is:

1. A method of heating a material located in a channel, the material having a melting range between a solidus temperature and a liquidus temperature, the method comprising:

providing a channel comprising a tubular passage or conduit for a flowable material and providing an internal inductive heating assembly in the material in the channel, the assembly being surrounded by a relatively narrow width of open channel area;

supplying a signal to the assembly to generate a magnetic flux in the assembly and/or the material, the magnetic flux generating inductive heating of the assembly and/or material and the magnetic flux generating a physical agitation in the material and/or in the assembly and being transmitted from the assembly to the material which lowers the solidus temperature of the material to a reduced solidus temperature; and wherein the material in the open channel area is heated from a nonflowable state to a flowable state.

2. The method of claim 1, wherein:

the agitation comprises a vibration in a frequency range of 5 to 500 kHz.

3. The method of claim 1, wherein:

the nonflowable state is a solid state at or below the reduced solidus temperature and the flowable state is a semi-solid state.

4. The method of claim 3, wherein:

the flowable state is a semi-solid state below the solidus temperature and above the reduced solidus temperature.

5. The method of claim 1, including:

adjusting the supplied signal to produce a desired range of temperature cycling which includes a change of the material into or from a flowable state across the reduced solidus temperature.

6. The method of claim 5, wherein:

the temperature cycling includes a change of the material between a solid state and a semi-solid state.

7. The method of claim 1, wherein:

the supplied signal is varied to provide alternate heating and cooling of the material across the reduced solidus temperature.

8. The method of claim 1, wherein:

the channel is provided in an outer element; and the method includes cooling of the material by thermal conduction of heat from the material to the outer element.

9. The method of claim 1, wherein:

the internal inductive heating assembly includes an exterior sheath disposed in contact with the material and an interior coil inductively coupled to the sheath; and the signal is supplied to the coil to generate the magnetic flux in one or both of the sheath and the material.

10. The method of claim 9, wherein:

both the inductive heating and physical agitation are generated in the sheath.

11. The method of claim 10, wherein:

the physical agitation generated in the sheath is transmitted to the material.

12. The method of claim 9, wherein:

both the inductive heating and physical agitation are generated in the material.

13. The method of claim 1, wherein:

both the inductive heating and physical agitation are generated in the material.

14. The method of claim 13, wherein:

the inductive heating is also generated in the assembly.

15. The method of claim 13, wherein:

the physical agitation is also generated in the assembly.

16. The method of claim 1, wherein:

both the inductive heating and physical agitation are generated in the assembly.

17. The method of claim 16, wherein:

the physical agitation is also generated in the material.

18. The method of claim 16, wherein:

the inductive heating is also generated in the material.

19. The method of claim 1, wherein:

the physical agitation is generated in the material.

20. The method of claim 1, wherein:

the physical agitation is generated in the assembly.

21. The method of claim 1, wherein:

the signal comprises current pulses providing high frequency harmonics in the coil.

22. The method of claim 1, wherein:

the material is a metal alloy.

23. The method of claim 1, wherein:

the material is a metal containing composition.

* * * * *